US007865117B2

(12) United States Patent
Selinger et al.

(10) Patent No.: US 7,865,117 B2
(45) Date of Patent: Jan. 4, 2011

(54) DEVELOPER STATION WITH SMOOTHING DEVICE AND METHOD FOR OPERATING A DEVELOPER STATION

(75) Inventors: Ralf Selinger, München (DE); Florian Köfferlein, München (DE); Admir Lela, Haar (DE); Uwe Höllig, Neubiberg (DE)

(73) Assignee: Oce Printing Systems GmbH, Poing (DE)

( * ) Notice: Subject to any disclaimer, the term of this patent is extended or adjusted under 35 U.S.C. 154(b) by 92 days.

(21) Appl. No.: 12/305,418

(22) PCT Filed: Jul. 4, 2007

(86) PCT No.: PCT/EP2007/056720

§ 371 (c)(1),
(2), (4) Date: Dec. 18, 2008

(87) PCT Pub. No.: WO2008/006747

PCT Pub. Date: Jan. 17, 2008

(65) Prior Publication Data

US 2009/0279922 A1 Nov. 12, 2009

(30) Foreign Application Priority Data

Jul. 10, 2006 (DE) ..... 10 2006 031 876

(51) Int. Cl.
*G03G 15/095* (2006.01)

(52) U.S. Cl. ..... 399/272

(58) Field of Classification Search ..... 399/233, 399/260, 269, 272, 274, 284
See application file for complete search history.

(56) References Cited

U.S. PATENT DOCUMENTS

| | | | |
|---|---|---|---|
| 4,226,524 | A | 10/1980 | Hashimoto |
| 4,487,496 | A | 12/1984 | Baier et al. |
| 4,628,860 | A | 12/1986 | Hosoya et al. |
| 4,656,365 | A | 4/1987 | Billings |
| 4,990,958 | A | 2/1991 | Brewington et al. |
| 5,234,786 | A | 8/1993 | Ueda et al. |
| 5,845,183 | A | 12/1998 | Sugiyama et al. |

(Continued)

FOREIGN PATENT DOCUMENTS

| | | | |
|---|---|---|---|
| DE | 31 18 995 | A1 | 11/1982 |
| DE | 692 14 033 | T2 | 1/1993 |

(Continued)

*Primary Examiner*—David P Porta
*Assistant Examiner*—Mark R Gaworecki
(74) *Attorney, Agent, or Firm*—Schiff Hardin LLP

(57) ABSTRACT

In a developer station for a printer or copier, a rotating developer roller is provided having a mixture of toner particles and ferromagnetic carrier particles accumulated on a surface of the developer roller as a layer, and a transfer zone at which the toner particles are transferred away from the developer roller. A smoothing device is provided with a smoothing element arranged before the transfer zone, the smoothing element being charged with a mechanical tension in a rest state of the developer roller and designed such that it exerts a force on and over an entire width of the layer formed by the mixture of the toner particles and the carrier particles present on the developer roller and smoothes the layer before the transfer of the toner particles. Within the developer roller at least one magnet is provided. The smoothing element comprises a magnetizable material attracted toward said at least one magnet to create said mechanical tension.

19 Claims, 2 Drawing Sheets

U.S. PATENT DOCUMENTS

| | | | |
|---|---|---|---|
| 5,863,329 | A | 1/1999 | Yamanouchi |
| 6,148,167 | A | 11/2000 | Komakine et al. |
| 2001/0055501 | A1 | 12/2001 | Inoue et al. |
| 2005/0036806 | A1 | 2/2005 | Hollig et al. |

FOREIGN PATENT DOCUMENTS

| | | | |
|---|---|---|---|
| DE | 101 52892 | A1 | 5/2003 |
| EP | 0 138 458 | | 4/1985 |
| EP | 0 394 228 | B1 | 7/1991 |
| EP | 0 522 813 | B1 | 9/1996 |
| WO | WO 89/08285 | | 9/1989 |

DEVELOPER STATION WITH SMOOTHING DEVICE AND METHOD FOR OPERATING A DEVELOPER STATION

BACKGROUND

The preferred embodiment concerns a developer station for a printer or copier with a rotating developer roller to which toner particles can be supplied, which toner particles accumulate on the surface of the developer roller and are subsequently transferable to a further rotating roller or a continuous belt in a transfer zone. The preferred embodiment also concerns a method for this.

In electrographic printers or copiers, image development methods are used that ink electrostatic charge images on surfaces (for example charge images on a photoconductor) across an air gap or in direct contact with toner particles. These toner particles are located on a developer roller that transfers them directly onto a cylindrical photoconductor or a continuous belt, or they are transferred from the developer roller to a further roller or a continuous belt from which the charge image is then inked on the photoconductor as an intermediate image carrier. The toner image present on the intermediate image carrier is then transferred and fixed onto a print medium (for example paper) in the further course of the printing or copying process.

In order to obtain a high-grade print quality, a homogeneous layer structure of the toner particles on the developer roller is to be maintained as an important prerequisite. Small irregularities in the toner layer can already lead to quality loss in the print image, for example color shifts and brightness fluctuations.

The following print documents are referenced as relevant prior art: DE 101 52 892 A1, DE 31 18 995 A1, EP 0 394 228 B1 and WO 89/08285 A.

U.S. Pat. No. 5,234,786 describes a developer station with a smoothing device which smoothes a mixture made up of carrier particles and toner particles. The smoothing device contains a magnetic smoothing element which exerts a pressure on the mixture layer and smoothes this layer. The developer roller stands directly opposite a photoconductor roller as an intermediate image carrier and transfers toner particles onto the surface of the photoconductor roller to ink the latent intermediate image.

U.S. Pat. No. 5,845,183 describes developer stations in which the developer consists exclusively of toner particles and not of a mixture of toner particles and carrier particles. The smoothing device smoothes the layer consisting exclusively of toner particles on developer rollers.

SUMMARY

It is an object to specify a developer station and a method that ensure or, respectively, ensures a high print quality.

In a developer station for a printer or copier, a rotating developer roller is provided having a mixture of toner particles and ferromagnetic carrier particles accumulated on a surface of the developer roller as a layer, and a transfer zone at which the toner particles are transferred away from the developer roller. A smoothing device is provided with a smoothing element arranged before the transfer zone, the smoothing element being charged with a mechanical tension in a rest state of the developer roller and designed such that it exerts a force on and over an entire width of the layer formed by the mixture of the toner particles and the carrier particles present on the developer roller and smoothes the layer before the transfer of the toner particles. Within the developer roller at least one magnet is provided. The smoothing element comprises a magnetizable material attracted toward said at least one magnet to create said mechanical tension.

DESCRIPTION OF THE PREFERRED EMBODIMENTS

Figure 1:
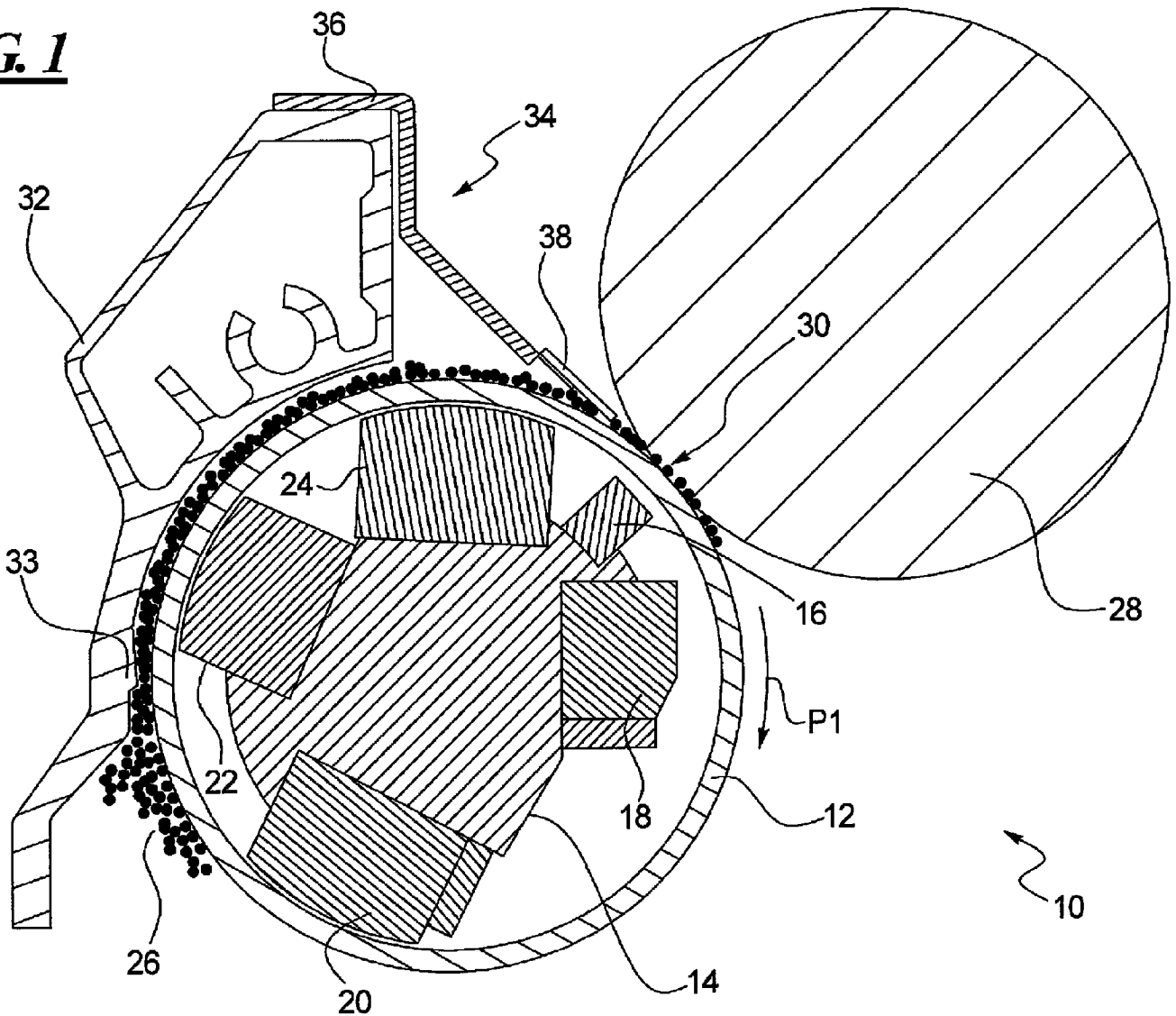
FIG. 1 is an exemplary embodiment with a belt-shaped smoothing element.

For the purposes of promoting an understanding of the principles of the invention, reference will now be made to the preferred embodiments/best mode illustrated in the drawings and specific language will be used to describe the same. It will nevertheless be understood that no limitation of the scope of the invention is thereby intended, and such alterations and further modifications in the illustrated device and such further applications of the principles of the invention as illustrated as would normally occur to one skilled in the art to which the invention relates are included.

According to one aspect of the preferred embodiment, an operating method is specified that ensures that a uniform toner layer is present in the transfer zone. The technical advantages that can be achieved with this method coincide with those described in the developer station.

The preferred embodiment can advantageously be used in electrographic printing or copying apparatuses whose recording methods for image generation are in particular based on the electrophotographic, magnetographic or ionographic recording principle. The printing or copying apparatuses can also use a recording method for image generation in which an image recording medium is directly or indirectly electrically energized, point by point. However, the preferred embodiment is not limited to such electrographic printing or copying apparatuses.

To better understand the present invention, reference is made in the following to the preferred exemplary embodiments presented in the drawings, which are described using specific terminology. However, it is noted that the protective scope of the invention should not thereby be limited since such variations and further modifications to the shown devices and/or the method, as well as such additional applications of the invention as they are indicated therein, are viewed as typical present or future expertise of a competent man skilled in the art. The Drawing Figures show exemplary embodiments of the invention.

FIG. 1 schematically shows in cross-section a section of a developer station 10. A developer roller 12 that rotates in the direction of the arrow P1 internally contains a magnet stator with multiple magnets 16, 18, 20, 22, 24 whose magnet axes are radially directed outwards, for example, and whose magnetic fields permeate the hollow developer roller 12. The polarity of the poles of the magnets 16 through 24 alternate in the revolution direction. A particle mixture made up of electrically-charged toner particles and ferromagnetic carrier particles (what is known as a two-component mixture 26) is supplied from a reservoir to the developer roller 12 via bucket wheels (not shown). In the printer or copier, the developer roller 12 serves to transport the toner particles to a further roller 28 where only the toner particles are transferred onto the surface of the further roller 28 in a transfer zone 30. A developer gap with a predetermined width is present between the developer roller 12 and the further roller 28 in the region of the transfer zone 30. The further roller 28 can already be an intermediate image carrier (for example a photoconductor roller) whose charge image is inked with the toner particles. Alternatively, the further roller can be an applicator element which is in turn provided with a uniform toner layer on its surface. This toner layer is then transferred onto an intermediate image carrier and is then inked to ink the charge image. A continuous belt can also be provided in place of the further roller 28.

Due to the magnetic field of the magnets 16 through 24, a magnetic brush forms in the radial direction of the developer roller 12 since the ferromagnetic carrier particles arrange and align along the magnetic field lines as a result of the force effect of the magnetic fields. An accumulate of carrier particles and toner particles adhering to them results on the surface of the developer roller 12 in the region of the outward-pointing poles of the magnets 16 through 24 (whose polarity can respectively alternate in the circumferential direction). Such a protruding accumulations of carrier particles and toner particles is designated as a magnetic brush due to the brush-like shape. The mixture made up of toner particles and carrier particles moves as well upon rotation of the developer roller 12 in the direction of the arrow P1.

A rigidly stationary housing wall 32 of the developer station 10 contains a scraper 32 which determines the layer thickness of the magnetic brush. A smoothing device 34 comprises a rigid mount 36 and a smoothing element 38. The mount 36 is firmly connected with the housing part 32. The smoothing element 38 is connected elastically or flexibly at the distal end of the mount 36. In the example according to FIG. 1, a thin metal band which has a thickness of 50 to 150 μm (advantageously of 90 to 110 μm) is used as a smoothing element 38. The metal band 38 is rectangular in cross-section and runs over the entire width of the developer roller 12 in the width direction of the developer roller 12, and thus completely covers the toner layer or the toner mixture carpet. The metal band 12 itself is in turn ferromagnetic and is charged by the magnetic field of the magnets 24 and 16 with an initial mechanical tension. In this way the metal band 38 presses—due to its elastic suspension at the mount 36 or due to the overall elasticity of mount 36 and metal band 38—against the layer of the two-component mixture 26 and smoothes the toner carpet or the magnetic brush. The metal band 38 is drawn over the entire width of the developer roller 12 with constant force relative to the magnetic brush. The existing magnetic forces of the magnets (in particular the magnets 24 and 16) generate a constant contact pressure force even given an irregular path of the surface of the developer roller 12. Concentricity fluctuations of the developer roller 12 and even thickness fluctuations of the magnetic brush or disruptions in the dosing of the toner layer at the scraper 33 are compensated in this manner. The smoothing system thus largely self-regulates and enables a constant contact pressure of the hard- or soft-magnetic smoothing element 38 without an adjustment of this smoothing element 38 being required. A stoppage of the two-component mixture can also not occur since the smoothing element 38 withdraws further upon rising pressure of the two-component mixture 26.

Instead of a magnetic smoothing element 38 in the form of a thin metal band, a non-magnetic metal band can also be used. It is advantageous when the contact force or the initial mechanical tension are generated with the aid of springs or an elastic element.

Figure 2:
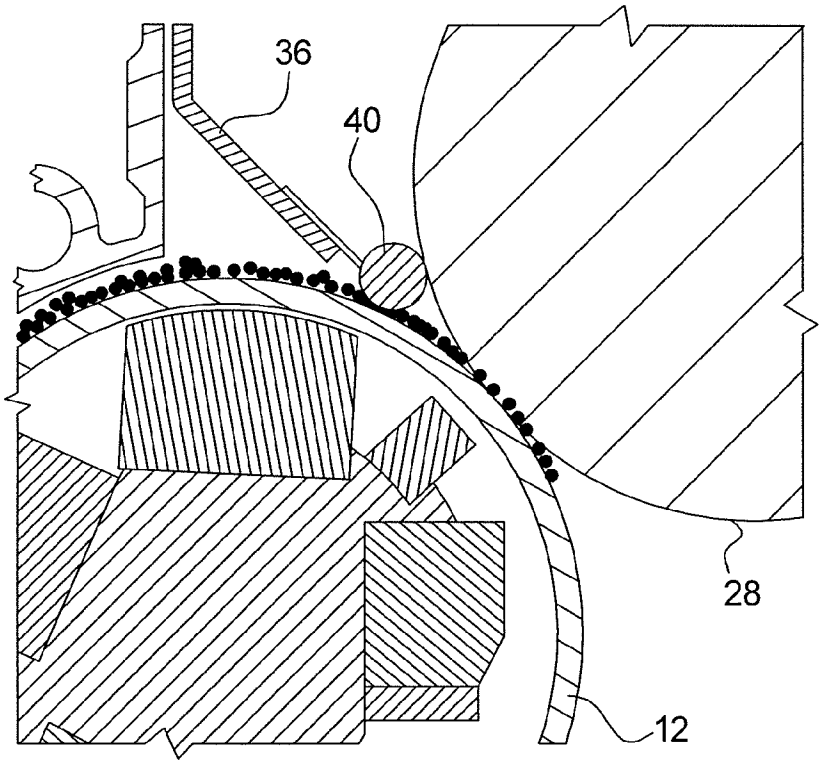
FIG. 2 is an exemplary embodiment with a cylindrical smoothing element.

FIG. 2 shows an additional exemplary embodiment in which a smoothing element 40 is cylindrical in design. A tube-shaped arrangement is also conceivable. Here the smoothing element 40 can also be hard- or soft-magnetic, such that the initial mechanical tension is generated via magnetic forces. However, it is also possible that the initial tension is generated by the dead weight of the smoothing element 40.

Figure 3:
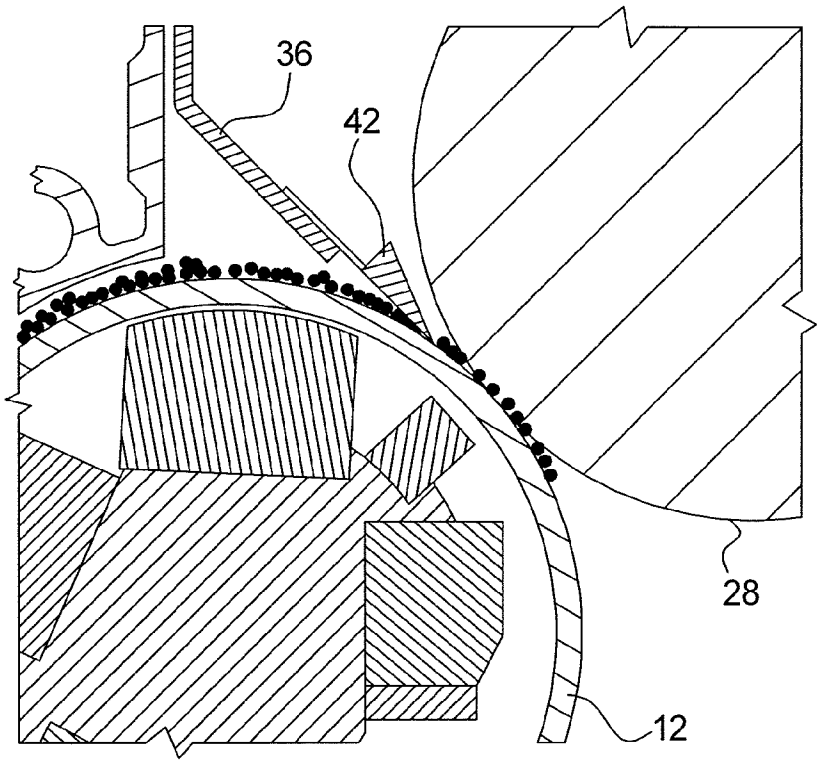
FIG. 3 is an exemplary embodiment with a smoothing element that is triangular in cross-section.

A further exemplary embodiment is presented in FIG. 3, in which a smoothing element 42 is triangular in cross-section and has a constant cross-section along the width of the developer roller 12. The tip of the triangle points in the tangential direction of the developer roller 12.

The end of the smoothing elements 38, 40, 42 should be arranged optimally close to the transfer zone 30; the distal end of the smoothing element 38, 40, 42 should advantageously extend up to the gap between developer roller 12 and further roller 28. It is thereby ensured that, as a result of the inhomogeneity of the magnetic fields, irregularities in the magnetic brush can again form in the region of the transfer zone 30. The discharge of carrier particles and toner particles is additionally reduced by the smoothing element 38, 40, 42 arranged immediately before the transfer zone 30.

It is also advantageous when the respective smoothing element 38, 40, 42 has a low-wear or wear-resistant coating at least on the side facing towards the toner layer. Such a wear-resistant coating can be a hard-chrome plated coating, a ceramic coating, or a plasma coating. For example, a titanium oxide layer that is advantageously applied via a plasma coating can be provided as a wear-resistant coating.

A toner system without ferromagnetic carrier particles can also be used instead of the two-component mixture made of toner particles and ferromagnetic carrier particles. In this case, the smoothing device 34 also produces the formation of a homogeneous, smoothed toner carpet in the inking zone.

Although preferred exemplary embodiments are shown and described in detail in the drawings and in the preceding specification, these should be viewed purely as examples and not as limiting the invention. It is noted that only preferred exemplary embodiments are presented and described, and all variations and modifications that presently and in the future lie within the protective scope of the invention should be protected

We claim as our invention:

1. A developer station for a printer or copier, comprising:

a rotating developer roller having a mixture of toner particles and ferromagnetic carrier particles accumulated on a surface of the developer roller as a layer;

an additional rotating roller receiving toner particles from said developer roller at a transfer zone;

an intermediate image carrier receiving toner particles from said additional rotating roller;

a smoothing device with a smoothing element arranged before the transfer zone, the smoothing element being charged with an initial mechanical tension in a rest state of the developer roller and designed such that it exerts a force on and over an entire width of the layer formed by the mixture of toner particles and carrier particles present on the developer roller and smoothes the layer before the transfer of the toner particles onto the additional roller;

within the developer roller at least one magnet having a magnetic field associated therewith;

said smoothing element comprising a magnetic material attracted to said at least one magnet to create said initial mechanical tension; and said smoothing element being arranged adjacent to said transfer zone and extending toward its distal free end in a direction of rotation of the developer roller up to and with the free end positioned at a gap between the developer roller and the additional roller at the transfer zone, said distal free end being in contact with said mixture of toner particles and ferromagnetic carrier particles on said surface of said developer roller as said layer.

2. A developer station according to claim 1 in which the smoothing device comprises a mount rigidly connected with a housing part of the developer station, the smoothing element being elastically or flexibly connected with the mount.

3. A developer station according to claim 2 in which the smoothing element comprises a thin metal band elastically or flexibly connected with the mount.

4. A developer station according to claim 3 in which the metal band has a thickness of 50 to 150 μm.

5. A developer station according to claim 1 in which the smoothing element is tube-shaped or cylindrical.

6. A develop station according to claim 1 in which the smoothing element is a triangle or drop-shaped in cross-section, a tip of triangle or of drop points being located in a tangential direction of the developer roller.

7. A developer station according to claim 1 in which the smoothing element is elastically attached on a mount, and the initial tension is also generated by a dead weight of the smoothing element.

8. A developer station according to claim 1 in which the smoothing element contains ferromagnetic material.

9. A developer station according to claim 1 in which the smoothing element has a low-wear or wear-resistant coating at least on a side facing towards the mixture layer.

10. A developer station according to claim 9 in which a hard-chrome coating, a ceramic coating, or a plasma coating is provided as said wear-resistant coating.

11. A developer station according to claim 1 in which the toner particles are contained in a two-component mixture which contains ferromagnetic carrier particles, the developer roller containing magnets arranged stationary inside it, said magnets holding the ferromagnetic carrier particles on the surface of the developer roller and transporting the toner particles adhering to the carrier particles to the transfer zone, and wherein the smoothing element smoothes the layer made up of the toner particles and the ferromagnetic carrier particles.

12. A developer station according to claim 1 in which the distal end of the smoothing element has a separation from the transfer zone between 0 to 0.1 times a diameter of the developer roller.

13. A developer station for a printer or copier, comprising:

a rotating developer roller having a mixture of toner particles and ferromagnetic carrier particles accumulated on a surface of the developer roller as a layer;

an additional rotating roller receiving toner particles from said developer roller at a transfer zone;

an intermediate image carrier receiving toner particles from said additional rotating roller;

a smoothing device with a smoothing element arranged before the transfer zone, the smoothing element being charged with an initial mechanical tension in a rest state of the developer roller and designed such that it exerts a force on and over an entire width of the layer formed by the mixture of toner particles and carrier particles present on the developer roller and smoothes the layer before the transfer of the toner particles onto the additional roller;

within the developer roller at least one magnet having a magnetic field associated therewith;

said smoothing element comprising a magnetic material attracted to said at least one magnet to create said initial mechanical tension;

the smoothing element having a wear-resistant coating at least on a side facing towards the mixture layer;

a titanium oxide layer applied as a plasma coating provided as the wear-resistant coating; and a titanium oxide layer applied as a plasma coating is provided as the wear-resistant coating.

14. An electrographic printer or copier, comprising:

a developer station, said developer station comprising a rotating developer roller having a mixture of toner particles and ferromagnetic carrier particles accumulated on a surface of the developer roller, an additional rotating roller receiving toner particles from said developer roller at a transfer zone, an intermediate image carrier receiving toner particles from said additional rotating roller, a smoothing device with a smoothing element arranged before the transfer zone, the smoothing element being charged with an initial mechanical tension in a rest state of the developer roller and designed such that it exerts a force on the mixture of toner particles and carrier particles present on the developer roller over an entire width of a layer of said mixture on said developer roller and smoothes the layer before the transfer of the toner particles onto the additional roller, within the developer roller at least one magnet having a magnetic field associated therewith, said smoothing element comprising a magnetizable material attracted to said at least one magnet which creates said initial mechanical tension, and said smoothing element being arranged adjacent to said transfer zone and extending toward its distal free end in a direction of rotation of the developer roller up to and with the free end positioned at a gap between the developer roller and the additional roller at the transfer zone, said distal free end being in contact with said mixture of toner particles and ferromagnetic carrier particles on said surface of said developer roller as said layer.

15. A method for operation of a developer station for a printer or copier, comprising the steps of:

providing said developer station with a rotating developer roller, an additional rotating roller with a transfer zone between the additional rotating roller and the rotating developer roller, and an intermediate image carrier adjacent said additional rotating roller, and wherein the developer roller has at least one magnet therein having an associated magnetic field;

providing a smoothing device with a smoothing element positioned before the transfer zone, said smoothing element comprising magnetizable material, said smoothing element being arranged adjacent to said transfer zone and extending toward its distal free end in a direction of rotation of the developer roller up to and with the free end positioned at a gap between the developer roller and the additional roller at the transfer zone, said distal free end being in contact with said mixture of toner particles and ferromagnetic carrier particles on said surface of said developer roller as said layer;

accumulating a mixture of toner particles and carrier particles on a surface of said developer roller as a layer and subsequently transferring the toner particles to said additional rotating roller at said transfer zone, and from said additional rotating roller transferring toner particles to said intermediate image carrier; and with said smoothing element, exerting a force on said mixture present as said layer on the developer roller over an entire width of the layer before the transfer of the toner particles onto the additional roller, and wherein said smoothing element is charged with an initial mechanical tension in a rest state of the developer roller by being magnetically attracted towards said at least one magnet.

16. A method according to claim 15 in which the smoothing element is elastically attached to a mount and the initial tension is also generated by a dead weight of the smoothing element.

17. A method according to claim 15 in which the smoothing element contains ferromagnetic material.

18. A developer station for a printer or copier, comprising:

a rotating developer roller having a mixture of toner particles and ferromagnetic carrier particles accumulated on a surface of the developer roller as a layer, and a transfer zone at which the toner particles are transferred away from said developer roller;

an intermediate image carrier receiving toner particles originating from said developer roller;

a smoothing device with a smoothing element arranged before the transfer zone, the smoothing element being charged with a mechanical tension in a rest state of the developer roller and designed such that it exerts a force on and over an entire width of the layer formed by the mixture of the toner particles and the carrier particles present on the developer roller and smoothes the layer before the transfer of the toner particles;

within the developer roller at least one magnet;

said smoothing element comprising a magnetizable material attracted toward said at least one magnet to create said initial mechanical tension; and said smoothing element being arranged adjacent to said transfer zone and extending toward its distal free end in a direction of rotation of the developer roller up to and with the free end positioned at a gap between the developer roller and the additional roller at the transfer zone, said distal free end being in contact with said mixture of toner particles and ferromagnetic carrier particles on said surface of said developer roller as said layer.

19. A method for operation of a developer station for a printer or copier, comprising the steps of:

providing said developer station with a rotating developer roller, an additional rotating roller with a transfer zone between the additional rotating roller and the rotating developer roller, and an intermediate image carrier adjacent said additional rotating roller, and wherein the developer roller has at least one magnet therein having an associated magnetic field;

providing a smoothing device with a smoothing element positioned before the transfer zone, said smoothing element comprising magnetizable material, the smoothing element having a wear-resistant coating at least on a side facing towards the mixture layer, said wear-resistant coating comprising a titanium oxide layer applied as a plasma coating;

accumulating a mixture of toner particles and carrier particles on a surface of said developer roller as a layer and subsequently transferring the toner particles to said additional rotating roller at said transfer zone, and from said additional rotating roller transferring toner particles to said intermediate image carrier; and with said smoothing element, exerting a force on said mixture present as said layer on the developer roller over an entire width of the layer before the transfer of the toner particles onto the additional roller, and wherein said smoothing element is charged with an initial mechanical tension in a rest state of the developer roller by being magnetically attracted towards said at least one magnet.

* * * * *